US006024606A

United States Patent [19]

Morikawa et al.

[11] Patent Number: 6,024,606

[45] Date of Patent: Feb. 15, 2000

[54] CONNECTOR PLUG

[75] Inventors: Seiichi Morikawa; Naoyuki Ono, both of Tokyo, Japan

[73] Assignees: Sony Corporation; SMK Co., Ltd., both of Tokyo, Japan

[21] Appl. No.: 08/981,067

[22] PCT Filed: Apr. 30, 1996

[86] PCT No.: PCT/JP96/01188

§ 371 Date: Dec. 10, 1997

§ 102(e) Date: Dec. 10, 1997

[87] PCT Pub. No.: WO96/42122

PCT Pub. Date: Dec. 27, 1996

[30] Foreign Application Priority Data

Jun. 12, 1995 [JP] Japan ..... 7-167883

[51] Int. Cl.[7] ..... H01R 9/03

[52] U.S. Cl. ..... 439/610

[58] Field of Search ..... 439/610, 680

[56] References Cited

FOREIGN PATENT DOCUMENTS 58-139685 9/1983 Japan .
59-192282 12/1984 Japan .
63-172069 11/1988 Japan .

OTHER PUBLICATIONS

"P1394a Draft Standard for a High Performance Serial Bus (Supplement)"; IEEE; P1394a Draft 2.0; Mar. 15, 1998; pp. 25–31.

*Primary Examiner*—Paula Bradley
*Assistant Examiner*—Antoine Ngandjui
*Attorney, Agent, or Firm*—McDermott, Will & Emery

[57] ABSTRACT

In a connector plug covering the housing (78) with contacts (82) in the socket engaging hole (81) by the metal shell portion (88) of the shield case (79), the metal shell portion (88) is roughly angular cylindrical in the direction of insertion of a plug, by installing the elasticity portion (77) bulged out to this roughly angular and cylindrical both-side portion (88) or bent to curve outwards the lower part of the roughly angular cylindrical both-side portion, and forms in the direction of insertion of a plug the gap (89) to let have flexibility to the metal shell portion (88) in the bottom. And then, if the connector plug (41) is inserted into the connector socket (42), by the elasticity portion (77) of the metal shell portion (88), the metal shell portion (88) has flexibility as a whole, the escape when the metal shell portion (88) is pressed in to the inner part, is absorbed, the metal shell portion (88) is surely stuck and connected to the connector socket (42),and the overall structure comes to be compact.

8 Claims, 7 Drawing Sheets

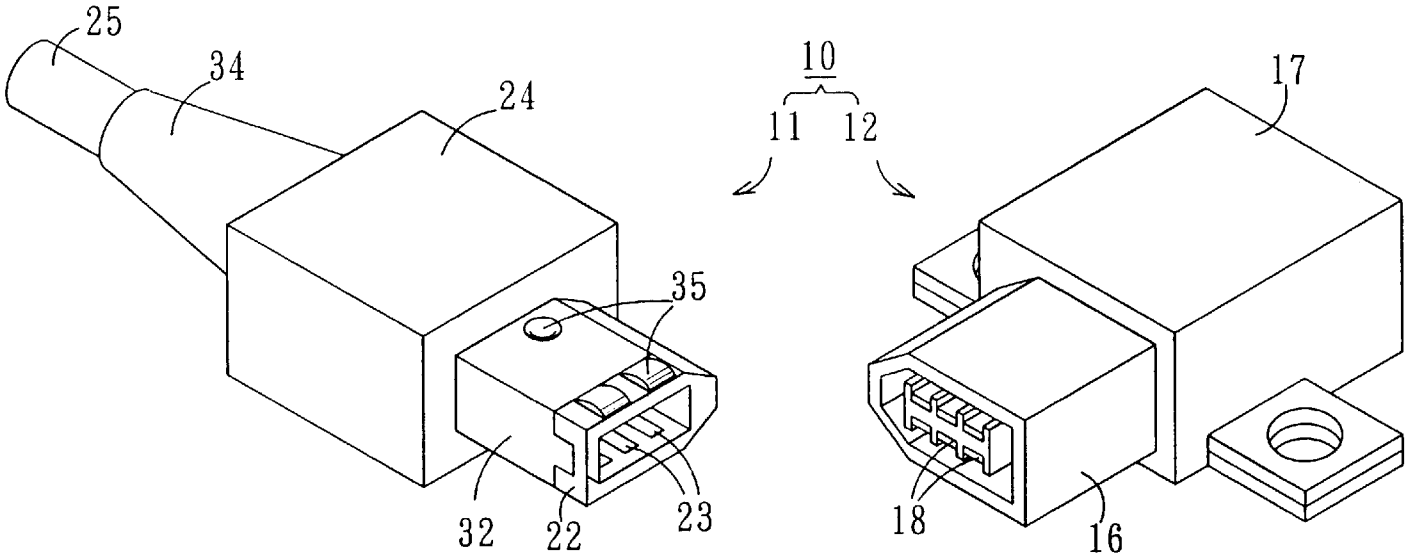
Fig. 7 (a) PRIOR ART
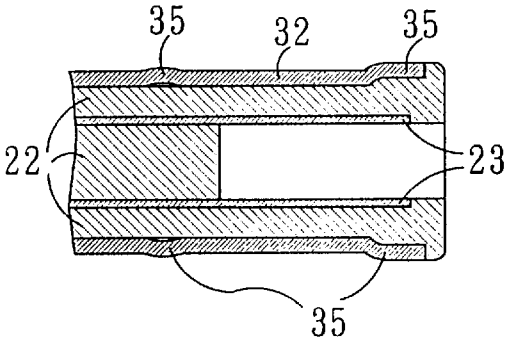
Fig. 7 (b) PRIOR ART

CONNECTOR PLUG

TECHNOLOGY FIELD

The present invention relates to a connector plug mainly be suitable for the transmission of a digital signal in case a VTR, TV, CD player, tuner, amplifier, etc. are mutually connected by using a connector composed of a connector plug and a connector socket.

BACKGROUND TECHNOLOGY

In general, a connector 10 is, as shown in FIG. 7(*a*), composed of a connector socket 12 installed at a body chassis side and the connector plug 11 mounted at the end of a cable 25.

The above-mentioned connector plug 11 has installed plural contacts 23 to the inside opened of the front of a housing 22, and the outer periphery of this housing 22 has been covered by an angular cylindrical metal shell 32. Said plural contacts 23 have been connected to each signal conductor and power line of the cable 25, and this connecting portion has been made by being covered with a cover 24.

Conventionally, for the sure contact when fitting the connector plug 11 to the connector socket 12, as shown in FIG. 7(*b*), a bulging-out portion 35 to let have a spring property has been formed both in the tip portion and the central portion in both the top face and the bottom face of the metal shell 32, respectively.

The conventional connector plug 11 is designed to hold the contact with the connector socket 12 side only by these bulging-out portions 35. However, even though it is desired to install the bulging-out portion 35 of sufficient shape to function as the spring portion to the angular cylindrical metal shell 32, under the existing circumstances where the down sizing has been demanded there is a dimensional restriction, resulting in a problem that a sufficient spring property cannot be obtained.

Therefore, the present invention is to aim at offering a connector plug that a sufficient spring property can be obtained without changing hardly the shape of the conventional metal shell.

Besides, the present invention is to aim at offering a connector plug that the construction as a whole is compact, and the metal shell portion is surely adhered and connected to the connector socket.

DISCLOSURE OF THE INVENTION

The present invention is, as shown in FIG. 1 and FIG. 3, a connector plug characterized by the fact that a housing 78 with plural contacts 82 in a socket engagement hole 81, in the connector plug composed by being covered with a metal shell portion 88 of a shield case 79 composed of the conductive metal plate, the said metal shell portion 88 is roughly angular cylindrical, by installing an elastic portion 77 bulged out to this angular cylindrical both-side portion or curved to warp the lower part of the roughly angular cylindrical both-side portion outwards in a longitudinal direction, and forming a gap to let have flexibility to the metal shell portion 88 proper in the bottom in the length direction.

When inserting a connector plug 41 into a connector socket 42, by the elasticity portion 77 in the metal shell portion 88, the metal shell portion 88 has flexibility as a whole, the recess when the metal shell portion 88 is pushed into the inside is absorbed by the gap 89, and the metal shell portion 88 is surely adhered and connected to the connector socket 42.

Besides, since the metal shell portion 88 proper has flexibility, the elastic portion like the conventional projection portion, etc. is not required, and the whole construction becomes compact.

BRIEF DESCRIPTION OF THE DRAWINGS

FIG. 3(*b*) is a cross-sectional view showing the second embodiment of the elasticity portion 77 in the metal shell portion 88.

FIG. 6(*b*) is a side view of cable 25.

FIG. 6(*c*) is a cross-sectional view showing different examples from the cable 25 in FIG. 6(*a*).

FIG. 7(*a*) is a perspective view of conventional connector plug and connector socket, and FIG. 7(*b*) is a cross-sectional view of tip part of connector plug in FIG. 7(*a*).

BEST FORM TO REALIZE THE INVENTION

Figure 1:
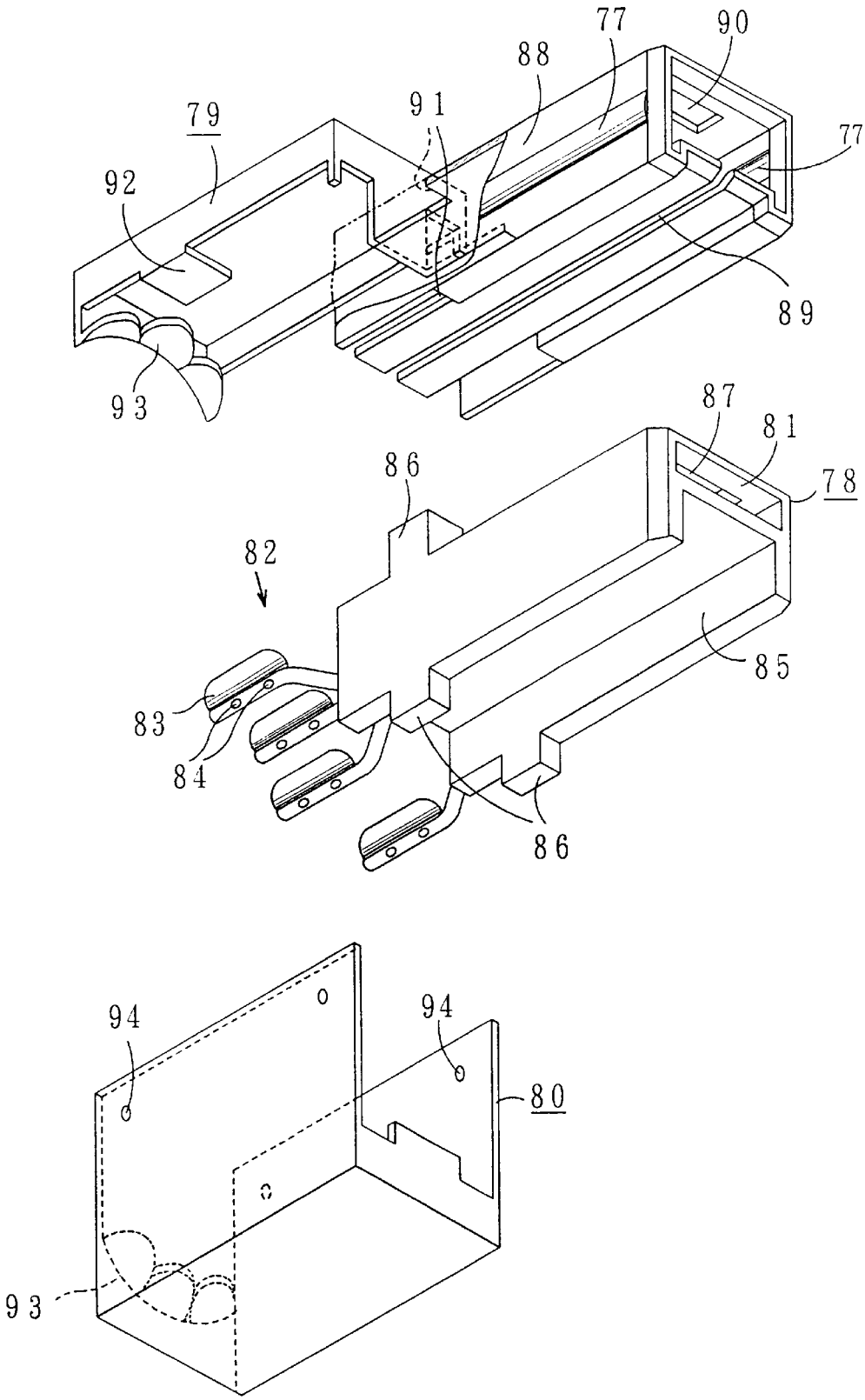
FIG. 1 is an decomposed perspective view showing an embodiment of the connector plug by the present invention.
Figure 6:
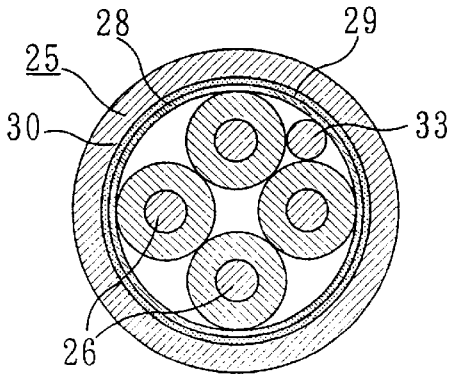
FIG. 6(*a*) is a cross-sectional view of cable 25.
Figure 6:
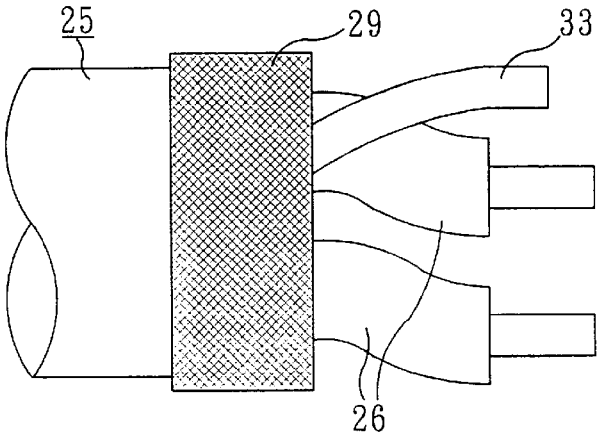
Figure 6:
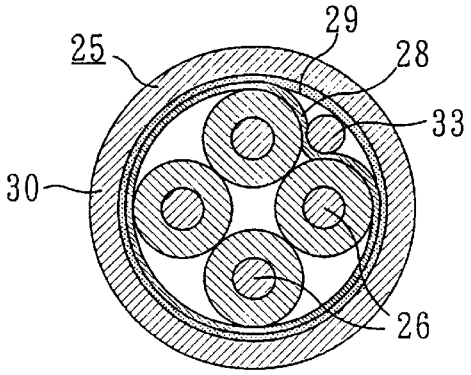

An embodiment of the present invention is explained on the basis of FIG. 1 or FIG. 6.

Figure 2:
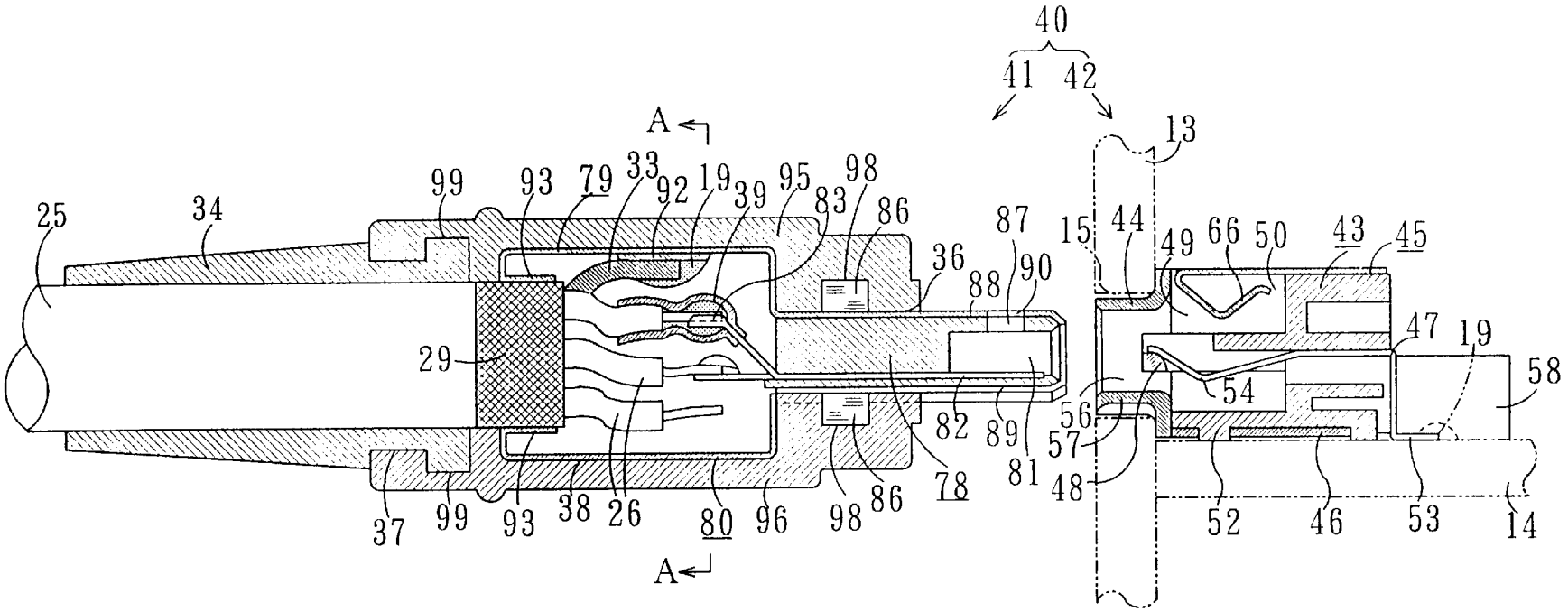
FIG. 2 is a cross-sectional view of connector plug and connector socket engaged and connected to this connector plug by the present invention.

In FIG. 2, the numeral 40 is a connector by the present invention, and this connector 40 is composed of a connector plug 41 and a connector socket 42.

Figure 5:
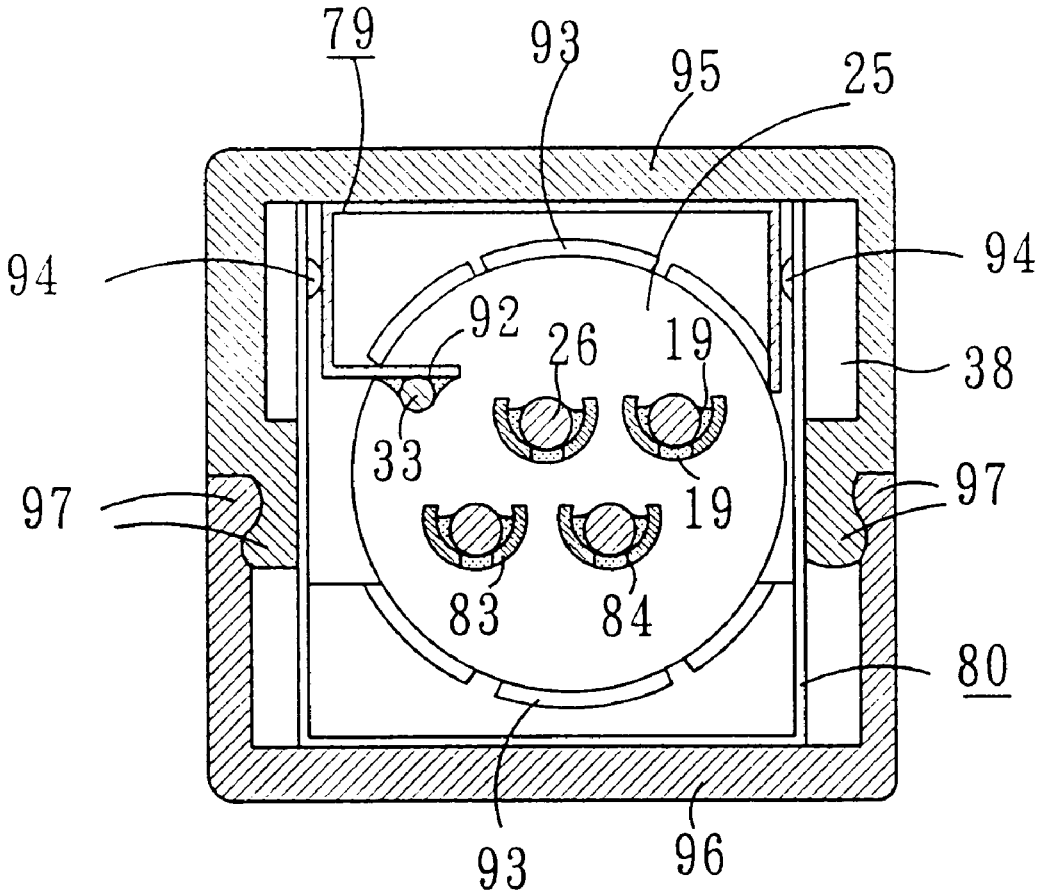
FIG. 5 is a cross-sectional view along the A—A line in FIG. 2.

The said connector plug 41 is constituted by a housing 78 made of insulating resin, an upper shield case 79 composed of the conductive metal plate, a lower shield case 80 composed of the conductive metal plate in the same way as shown in the decomposed perspective view of FIG. 1, and an upper cover 95 made of insulating resin and a lower cover 96 made of insulating resin in the same way as shown in FIG. 2 and FIG. 5.

The said housing 78 has opened a socket engagement hole 81 in the front, formed a bottom groove 85 on the bottom face in the longitudinal direction, pierced and installed a half lock hole 87 on the top face, projected through preventive protruded portions 86 up and down in the back, and formed the chamfering in the front end.

Besides, the said housing 78 is integrally molded with the plural contacts 82, one end of the contacts 82 meeting at the socket engagement 81 side, and the other end of the contacts 82 protruding backward. A terminal portion 83 is formed in the other end of contacts 82 protruding backward. This terminal portion 83 is, as shown in FIG. 5, of semicircle with a somewhat larger diameter than a signal conductor 26 to be connected, as well, in the bottom of this terminal portion 83, a small hole 84 of size to an extent that molten solder 19 spontaneously flows into but does not flow out downwards has been pierced and installed. Concretely, supposing that the diameter of the signal conductor 26 is of 0.3 mm, the diameter of the semicircular portion of terminal portion 83 is of 1.0 mm more or less, and the diameter of the small hole 84 shall be of 0.3 mm more or less. Since this terminal portion 83 has small adjacent spaces, it is desirable to leave them folding alternately and vertically, and remaining left in a zigzag way.

The said upper shield case 79 forms the metal shell portion 88 as a whole in the front end. Since this metal shell portion 88 inserts the said housing 78 from backwards, the whole is roughly angular cylindrical, the bottom is folded out to somewhat groove type so as to fit with the said bottom groove 85, as well the gap 89 peculiar to the present invention is formed with gaps in the length direction for the recess when having elasticity to the metal shell portion 88 itself.

Figure 3:
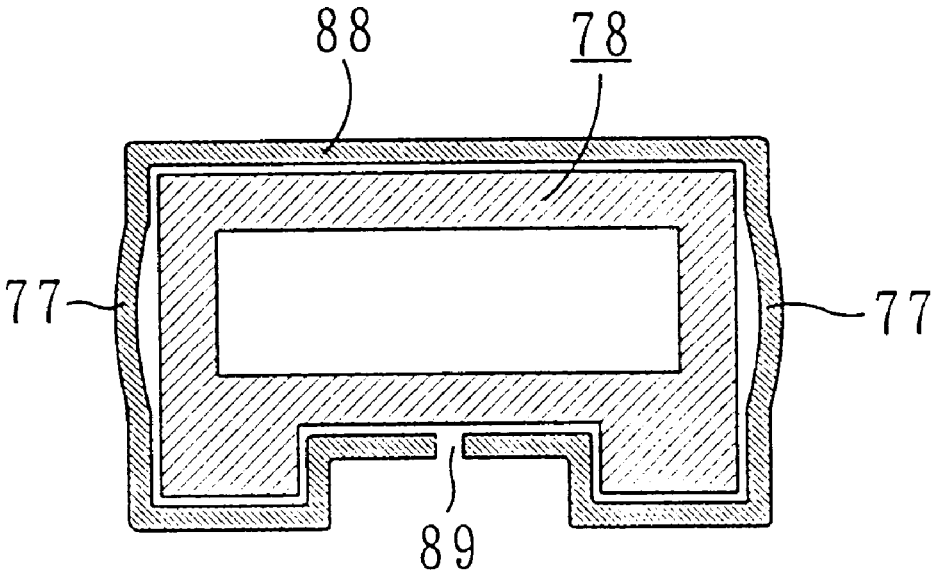
FIG. 3(*a*) is a cross-sectional view showing the first embodiment of the elasticity portion 77 in the metal shell portion 88.
Figure 3:
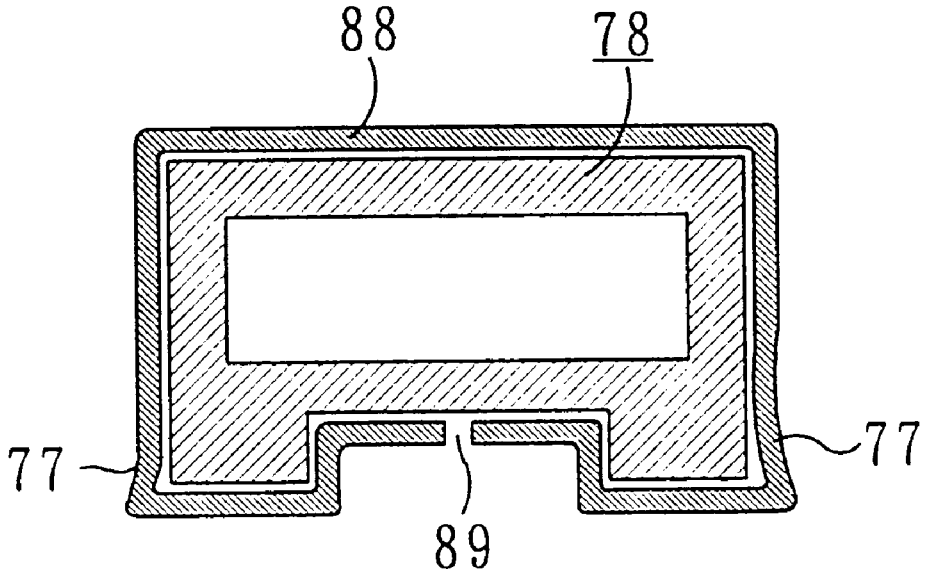

Concretely, as shown in FIG. 3(*a*), the elasticity portion 77 bulged out to the both-side portion of metal shell portion 88 is installed in the longitudinal direction. Or else, as shown in FIG. 3(*b*). the elasticity portion 77 bent from the lower part of the both-side portion of the metal shell portion 88 to the outside part is installed in the longitudinal direction. And then, if this metal shell portion 88 is engaged with the connector socket 12, the metal shell portion 88 as a whole is pressed and connected to an engaging portion 56 of the shield case 44 with elasticity by the deformation of the elasticity portion 77. At this time, the gap 89 serves as recess.

In the upper plate of the said metal shell portion 88, a half lock hole 90 is drilled, and both in the upper plate and the lower plate, a notch portion 91 is formed so that the said through preventive projection 86 will be protruded.

In the back end of the said upper shield case 79, forms a shallow lid type by the upper plate and side plates in 4 directions, and integrally forms a semicircular portion 93 doubled out from the back end to the inside and a side plate connecting terminal portion 92 folded out from the side to the inside.

The said lower shield case 80 forms a box type without lid by the bottom plate and 4-direction side plates contrary to the upper shield case 79, integrally forms the semicircular portion 93 folded out from side plates in the back end to the inside, or else, in right and left side plates, plural protruded portions 94 are projected and formed to assure the contact with the upper shield case 79.

The said upper cover 95 and the lower cover 96 are, as shown in FIG. 2 and FIG. 3, of shape divided by 2 horizontally to become roughly angular cylindrical when mutually engaged, form an engaging portion 97 in the mating part of both sides, respectively, form an angular hole 36 in the front and a round hole 37 in the back, form a hollow portion 38 inside, and further form an engaging groove 98 and an engaging groove 99, respectively, on the internal wall of the angular hole 36 and the round hole 37.

The order to assemble the connector plug 41 is explained by each part as above.

First, as shown in FIG. 2 and FIG. 6, in the cable 25 installing a bush 34 as a whole to the tip, the signal conductor 26 and a grounding cable 33 are exposed, a shield 29 is folded out to the external circumference of an insulating jacket 30, moreover an insulating tube 39 is fitted to the signal conductor 26, and the end remains processed. There are grounding cables 33, what are inserted between the conductive tape 28 and the signal conductor 26 as shown in FIG. 6(*a*) and what are inserted between the shield 29 and the conductive tape 28 as shown in FIG. 6(*c*), and any of them may be used.

Next, signal conductors 26 are placed one by one onto the terminal portion 83 of contacts 82, and connected with solder 19.

At this time, leave to confirm from the bottom face of the terminal portion 83 whether solder 19 flows also into the small hole 84. If connected, by shifting the insulating tube 39 till the connection part and heating it, the insulating tube 39 is thermally shrunken, and stuck to the signal conductor 26 and/or the terminal portion 83, protecting from the short-circuit or disconnection.

The housing 78 connected with the signal conductor 26 is inserted from the back edge into the metal shell portion 88 of the upper shield case 79, and pressed in until the slip-out protruded portion 86 will be properly connected to the notch portion 91. After then, the grounding wire 33 is connected to the connecting terminal portion 92 with solder 19.

Next the lower shield case 80 is engaged to the upper shield case 79. At this time, the shield 29 folded to the outside of the insulating jacket 30 is contacted with the semicircular portion 93 of the upper shield case 79 and the semicircular portion 93 of the lower shield case 80, as well the protruded portion 94 of the lower shield case 80 is connected by pressure to the side plate of the upper shield case 79. The upper cover 95 is covered to the upper shield case 79 side, upper and lower engaging portions 97 are fit in and engaged by covering the upper cover 95 to the upper shield case 79 side and covering the lower cover 96 to the lower shield case 80 side. Just then, the slip-out protruded portion 86 is engaged with the engaging groove 98, the upper shield case 79 and the lower shield case 80 are engaged with the hollow portion 38, the point portion of the bush 34 is engaged with the engaging groove 99, the point portion of the metal shell portion 88 is protruded from the angular hole 36, and the assembling of the connector plug 41 is completed.

Figure 4:
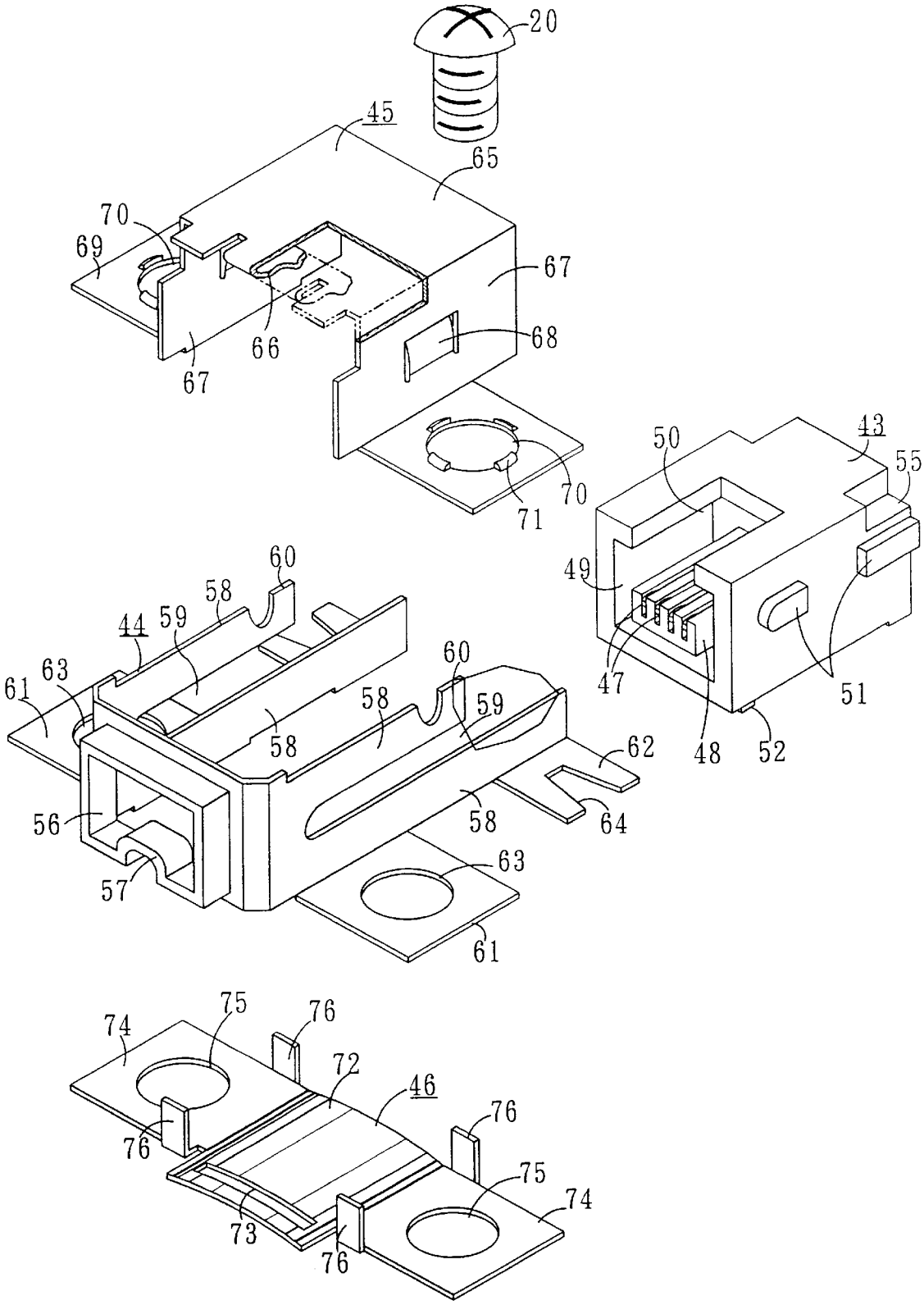
FIG. 4 is an decomposed exploded perspective view of connector socket in FIG. 2.

Next, details of the connector socket 42 are explained by FIG. 2 and FIG. 4.

This connector socket 42 is composed of a housing 43 made of insulating resin, a shield case 44 made of conductive metal plate, an shield upper lid 45 made of conductive metal plate, and a shield base plate 46 made of conductive metal plate.

The said housing 43 installs by protruding a terminal receiving portion 48 engaging with the said connector plug 41 to the front opening portion 49 side, arranges a plural of terminals 47 at regular intervals to this terminal receiving portion 48, the point edge of this terminal 47 is somewhat protruded from downward the terminal receiving portion 48, becoming a contact portion 54, and the other edge of the terminal 47 is protruded from the back portion of the housing 43, resulting in a terminal portion 53.

In the upper plate part of this housing 43, a top face notch portion 50 is formed from the front edge, in the side plate portion, 2 pieces of mating portions 51 are horizontally formed with gap for an engaging hook 68 described later, and, in the back edge angular section, an engaging concave portion 55 is formed, and in the bottom, an arrangement determining protruded portion 52 is formed.

The said shield case 44 forms the engaging portion 56 in the center by the press process of conductive metal plate, and the bottom of this engaging portion 56 possesses the push-in direction determining protruded portion 57 in the bottom of this engaging portion 56. A side plate portion 58 is folded and formed backwards from the both-side portion of this engaging portion 56, a slitting 59 is formed from the back edge in this side plate portion 58, a tongue piece 60 is formed at the back upper edge of this side plate portion 58. Besides, a screw fastening piece 61 and a fixing piece 62 is folded outwards and formed in the bottom of the side plate portion 58, in the screw fastening piece 61, a screw hole 63 is formed, and in the fixing piece 62, a V-shaped notch portion 64 is formed.

The said the shield upper lid 45 is composed by folding in the downward ]-shaped form without bottom using the conductive metal plate, folding the front edge part of a top face portion 65 at about 180 degrees inside, forming the half lock piece 66 into one piece, further cutting, raising and forming an engaging hook 68 on a side plate portion 67 of both sides, furthermore the screw fastening piece 69 is folded and formed outwards in the bottom of this side plate portion 67. In this screw fastening piece 69, a screw hole 70 is drilled and installed, and for improvement in reliability at screw fastening, plural protruded portions 71 are formed in one piece around the screw hole 70.

The said shield base plate 46 is composed of a long and narrow conductive metal plate, the central part is made a concave bottom 72, forms a positioning hole 73, drills and installs screw holes 75 in screw fastening pieces 74 into one body at both ends, and besides, forms a clinching piece 76 between the concave bottom 72 and the screw fastening piece 74 and protruding upwards.

Next, the assembling order of the connector socket 42 is explained.

The housing 43 is engaged in such a way that the mating projection 51 will be guided to the slitting 59 from backwards of the shield case 44, and after engagement, it is fixed by folding the tongue piece 60 to the engaging concave portion 55 side. Just then, the terminal receiving portion 48 is faced to the front of the engaging portion 56.

Next, the shield upper lid 45 is covered from upward of the shield case 44. Just then, the side plate portion 67 of the shield upper lid 45 is engaged sliding the outside of the side plate portion 58 of the shield case 44, and the engaging hook 68 is engaged in the concaved portion formed at space of the slitting 59 and 2 convex mating portions 51. At the same time a half lock piece 66 is freely fitted to the top face notch portion 50 of the housing 43, faced to the upper part of the terminal receiving portion 48, as well make the screw hole 63 and the screw hole 70 concur, and the screw fastening piece 61 and the screw fastening piece 69 are overlapped.

Next, the shield base plate 46 is applied in such a way that the positioning hole 73 and the arrangement determining protruded portion 52 be fitted from the bottom face of the housing 43. And then, first the screw hole 75 of the screw fastening piece 74 of a party is made in concurrence, 3 pcs. of screw fastening pieces 74, 61 and 69 are stuck and it is fixed by folding the edge of the clinching piece 76.

Next, if the screw fastening piece 74 of other side is pushed in to be stuck to the screw fastening piece 61 of another side, the bottom of the housing 43 in the part of the concave bottom 72 is pushed, and the top face of the housing 43 is press in the inner face of the top face portion 65 of the shield upper lid 45. By the clinching piece 76 in this state, 3 pcs. of screw fastening pieces 74, 61 and 69 as stuck, and it is fixed by folding the edge of the clinching piece 76.

The connector socket 42 thus assembled fits the engaging portion 56 with a through hole 15 of a chassis 13, is placed in the specified position of a wiring plate 14, is fixed by a screw 20, and fixes the fixing piece 62 with solder 19. Further the terminal portion 53 of the terminal 47 is connected with solder 19.

If the connector plug 41 constituted as above is inserted into the connector socket 42, the metal shell portion 88 of the upper shield case 79 is fitted with the engaging portion 56 of the shield case 44. At this time, it is inserted in such a way that the bottom groove 85 and the press in direction determining protruded portion 57 be mated, and there is no way to insert by turning over the connector plug 41. When inserting the metal shell portion 88 into the engaging portion 56, by the elasticity portion 77, the whole metal shell portion 88 has elasticity, and escape when the metal shell portion 88 is pressed in inward is absorbed by the gap 89, and the metal shell portion 88 and the engaging portion 56 are surely stuck If the metal shell portion 88 is inserted more, the contact 82 is contacted with the contact portion 54 of the terminal 47, connected electrically and surely, besides the half lock piece 66 of the shield upper lid 45 is engaged with the half lock hole 90 of the metal shell portion 88 and the half block hole 87 of the housing 78, the connector plug 41 is half locked to the connector socket 42.

When inserting the connector plug 41 into the connector socket 42 or pulling it out, even though an external force is added to the direction intersecting with the inserting direction to the connector plug 41, the connector socket 42 is not only fixed by the screw 40, but also fixed by the fixing piece 62 of the shield case 44, thereby it withstand to the use for a long period without exfoliating the terminal portion 53 of the terminal 47.

Since the metal shell portion 88 of the present invention is cylindrical, has the gap 89 to let have flexibility to the metal shell portion 88 proper in the bottom in the length direction, no elasticity portion like conventional protruded portion, etc. is required, and the overall construction is made compact.

Besides, the metal shell portion 88 is roughly angular and cylindrical, by installing in the longitudinal direction the elasticity portion 77 bulged out to this roughly angular and cylindrical both-side portion, or installing in the longitudinal direction the elasticity portion 77 bent to curve outward the down part of the roughly angular and cylindrical both-side portion, and forming in the length direction the gap 89 to have elasticity to the metal shell portion 88 proper in the bottom if the connector plug 41 is inserted into the connector socket 42, by the elasticity portion 77 of the metal shell portion 88, the metal shell portion 88 proper has flexibility, and escape when the metal shell portion 88 is pressed inward, is absorbed by the gap 89, and the metal shell portion 88 is surely stuck and connected with the connector socket 42.

Industrial Utilization Possibility

As mentioned above, in case a VTR, TV, CD player, tuner, amplifier, etc. are mutually connected by using a connector plug and a connector socket, the connector plug related to the present invention is adequate to use mainly in the transmission of digital signals.

We claim:

1. Connector plug comprising:

a housing including a plurality of contacts, a metal shell portion of a shield case made of a conductive metal plate, said metal shell portion having an essentially rectangular cross section, an elastic engagement portion formed on each of two opposite sides of the metal shell portion, and a gap which is formed in the metal shell portion between the two opposite sides thereof, which extends longitudinally alone the metal shell portion, which provides flexibility to the metal shell portion, and which is formed along a bottom portion thereof.

2. Connector plug as set forth in claim 1, wherein each elastic engagement portion is one of angular and cylindrical in shape and bulges out on both-sides of the plug, and wherein the gap is formed so as to extend in the direction of insertion of the plug into a socket.

3. Connector plug as set forth in claim 1, wherein the metal shell portion has both rectangular and cylindrical portions which are arranged in the direction of insertion of the plug, wherein the elastic engagement portions bulge out from the rectangular portion on both-sides thereof, and wherein the gap is formed in the direction of insertion of the plug into a socket.

4. Connector plug as set forth in claim 1, wherein each elastic engagement portion is bent to curve outwards from a lower part of this essentially rectangular cross-sectional metal shell portion on both sides thereof, and wherein the gap is formed in the direction of insertion of the plug into a socket.

5. A connector plug comprising:

a housing containing a plurality of contacts adapted for electrical connection when inserted into a socket;

a metal shell disposed about said housing, said metal shell acting as a shield case;

opposed outwardly convex elastic portions formed in said metal shell, said outwardly convex portions engaging surfaces of the socket into which the connector plug is inserted, and an elongate gap which extends along the axial length of the metal shell, said elongate gap being formed in an essentially flat recessed wall portion of said metal shell.

6. A connector plug comprising a housing with contacts for engagement with a socket and for establishing electrical connection therebetween;

a metal shell which forms a shield case and which is composed of a conductive metal plate that covers the housing, the housing and the metal shell respectively having a channel-like indentation portion which has side walls and a contiguous base wall, the metal shell having a gap which extends longitudinally along the base wall portion of the channel-like indentation formed therein; and projections which are formed in the metal shell and which project in a direction which is essentially normal to the side walls of the channel-like indentation portions.

7. A connector plug as set forth in claim 6, wherein the housing has an essentially rectangular cross-section and has a pair of opposed major sides and a pair of opposed minor sides, wherein the channel-like indent portion is formed in a major surface, and wherein the projections are formed in corresponding minor sides of the metal shell.

8. A connector plug comprising:

a housing having a rectangular cross-sectional portion in which a channel-like recess is formed longitudinally along a lower surface thereof, the channel-like recess having side walls and a bottom wall;

a shield case in the form of a metal sheet wrapped about the rectangular cross-sectional portion of the housing so that edge portions of the metal sheet juxtapose one another in the channel-like recess in a manner to define a gap therebetween; and projections formed on opposite wall portions of the shield case and adapted to extend in a direction which is essentially normal to the side walls of the channel-like recess.

* * * * *

UNITED STATES PATENT AND TRADEMARK OFFICE

CERTIFICATE OF CORRECTION

PATENT NO. : 6,024,606
DATED : February 15, 2000
INVENTOR(S) : Seiichi Morikawa, et. al.

It is certified that error appears in the above-indentified patent and that said Letters Patent is hereby corrected as shown below:

Column 6, line 63, claim 1, change "alone" to --along--.

Signed and Sealed this

Twentieth Day of March, 2001

Nicholas P. Godici

*Attest:*

NICHOLAS P. GODICI

*Attesting Officer*

*Acting Director of the United States Patent and Trademark Office*